US005198156A

United States Patent [19]

Middleton et al.

[11] Patent Number: 5,198,156

[45] Date of Patent: Mar. 30, 1993

[54] AGITATORS

[75] Inventors: John C. Middleton, Davenham; Colin Ramshaw, Norley, both of England

[73] Assignee: Imperial Chemical Industries PLC, London, England

[21] Appl. No.: 878,908

[22] Filed: May 6, 1992

Related U.S. Application Data

[62] Division of Ser. No. 11,285, Feb. 5, 1987, abandoned.

[30] Foreign Application Priority Data

Feb. 17, 1986 [GB] United Kingdom ..... 8603904

[51] Int. Cl.[5] ..... B01F 3/04; B01F 5/10

[52] U.S. Cl. ..... 261/87; 261/93; 366/244; 366/263; 366/317; 366/102; 366/343; 366/325; 366/241; 416/243; 416/197 R

[58] Field of Search ..... 261/87, 93; 366/101-107, 215, 316, 317, 169, 241, 244-247, 249-251, 262, 263, 265, 279, 343, 329, 325, 326, 327; 210/219; 416/197 A, 197 R, 243; 422/225-231, 135

[56] References Cited

U.S. PATENT DOCUMENTS

| | | | |
|---|---|---|---|
| 208,783 | 10/1878 | Baird | 366/102 |
| 1,353,881 | 7/1921 | Thomas | 366/107 |
| 1,372,834 | 3/1921 | Schmelzer | 416/197 |
| 1,445,935 | 2/1923 | Daman et al. | 356/315 |
| 1,653,189 | 12/1927 | Oliphant | 261/87 |
| 3,066,921 | 12/1962 | Thommel et al. | 366/315 |
| 3,104,424 | 9/1963 | Immel | 366/102 |
| 3,154,601 | 10/1964 | Kalinske et al. | 366/102 |
| 3,660,244 | 5/1972 | Che | 435/315 |
| 3,776,528 | 12/1973 | Toto | 422/225 |
| 4,112,517 | 9/1978 | Giombini | 366/102 |
| 4,305,673 | 12/1981 | Herbst | 366/317 |
| 4,548,765 | 10/1985 | Hultholm et al. | 366/102 |
| 4,670,397 | 6/1987 | Wegner et al. . | |
| 4,779,990 | 10/1988 | Hjort et al. | 366/102 |

FOREIGN PATENT DOCUMENTS

| | | | |
|---|---|---|---|
| 451893 | 10/1948 | Canada | 366/102 |
| 859575 | 12/1970 | Canada | 366/102 |
| 1075559 | 2/1960 | Fed. Rep. of Germany | 261/87 |
| 2023981 | 11/1971 | Fed. Rep. of Germany | 261/87 |
| 2207144 | 8/1973 | Fed. Rep. of Germany . | |
| 21635 | 2/1981 | Japan | 366/102 |
| 7411362 | 3/1976 | Netherlands | 216/219 |
| 679401 | 8/1979 | U.S.S.R. | 366/103 |
| 1659 | of 1908 | United Kingdom | 416/197 R |

*Primary Examiner*—Tim Miles

*Attorney, Agent, or Firm*—Cushman, Darby & Cushman

[57] ABSTRACT

The turbine agitator assembly including a reservoir for liquid, a rotor mounted in the reservoir and with a plurality of radially extending blades, and sparger means for introducing a fluid into liquid in the reservoir. The fluid sparger means and the rotor are so constructed and arranged that, in use, the rotor blades (submerged in the liquid) and/or the liquid flow they generate disperse the sparged fluid. Each of the blades is hollow and has a discontinuous leading edge, only a single trailing edge along an acute angle, no external concave surface and an open radially outer end.

12 Claims, 3 Drawing Sheets

AGITATORS

This is a division of application Ser. No. 07/011,285, filed Feb. 5, 1987 and now abandoned.

BACKGROUND OF THE INVENTION

This invention relates to agitators for the dispersion of a fluid in a liquid.

Disc turbine agitators with a plurality of axially aligned plane paddle blades are known for the dispersion of sparged gases as small bubbles in liquids in tanks and the concomitant mixing of the tank contents. In use, a vortex low pressure zone forms behind each rotating blade of the turbine, and with the gas flow rates frequently encountered in industry, the gas tends to collect and be held as a cavity in this zone; this disadvantageously reduces dispersion and mixing efficiency and can cause turbine blade erosion. The same problem would be found with a sparged liquid less dense than the tank liquid.

SUMMARY OF THE INVENTION

We have now designed a turbine agitator in which vortex formation and its deleterious consequences are minimised, and which provides efficient dispersion and mixing.

Accordingly, the present invention provides a turbine agitator assembly comprising a reservoir for liquid, a rotor mounted in the reservoir and with a plurality of radially extending blades, and means for sparging a fluid into liquid in the reservoir, the fluid sparging means and the rotor being so constructed and arranged that, in use, the rotor blades (submerged in the liquid) and/or the liquid flow they generate disperse the sparged fluid, characterised in that each of the blades is hollow and has a discontinuous leading edge, only a single trailing edge along an acute angle, no external concave surface and an open radially outer end.

In conventional disc turbine agitators, we have found that vortices are generated where fluid flow is not streamline along the blade surface, but becomes 'separated', for example at projecting edges (e.g. the axial edges of conventional axially-aligned paddle blades), where a trailing external surface is concave, or where there is no acute trailing edge, e.g. with circular, elliptical, square or oblong cross-section blades.

We believe that any blade fulfilling the foregoing criteria for a blade of this invention will be suitable. Within this, the blade may have a symmetrical cross-section, having a circular, parabolic or elliptical section leading face merging smoothly into a sphenoidal (i.e. wedge shaped) or sharply elongate parabolic or elliptical section trailing part. It will be seen that the term 'trailing edge along an acute angle' thus includes both angular and sharply radiused edges. Parabolic or elliptical section leading faces are favoured as improving the streamline around the blade, although the leading part may also be sphenoidal. A preferred blade shape is a symmetrical aerofoil-like cross-section.

The blade is hollow and the leading edge is discontinuous, for example in the form of holes, or in the preferred form of a slot symmetrically disposed in the leading face of a symmetrical cross-section blade. The radially outer end of the blade is at least partially open, so that such a blade provides a scooping action which disperses and mixes by pumping the scooped liquid radially outwards.

Typical dimensions of a blade in the present assembly are:

blade length = D/4, projected height = D/5, where D is the overall rotor diameter.

Typically the blade will be made of conventional metals or plastics used for turbine agitator paddles.

In its general form the blade has two elongate axes, one radial and one transverse, defining a 'blade plane'. This blade plane will generally coincide with or lie parallel to any plane of rotation described by the blade in use, that is the blade is usually not set at an 'attack angle' on or with respect to the rotor shaft. However, this latter possibility is not excluded, but the skilled person will readily appreciate that the angle should not be so great that the trailing (or any leading) edge behaves effectively as an axially projecting edge, and/or any trailing part of the blade surface behaves effectively as a concave surface, in tending to produce substantial vortices.

The blades of the turbine rotor may be arranged in the same rotational plane or in any number of parallel rotational planes. It is preferred that the blades are arranged regularly within any one plane so that rotational balance is maximised. Preferably they are also (as apt) so arranged along the shaft and with respect to each blade in any other plane in accordance with routine engineering practice that torsional balance is maximised, for example, they are arranged with equal numbers of blades in each plane, and with corresponding blades in different planes axially in register or with all the planes regularly rotationally skewed with respect to one another.

The blades may also be set at any angle to the rotor shaft in an axial direction, other than a right angle in order to provide an axial component of the discharge flow.

The rotor may have 2 or more blades. The mixing efficiency of the turbine will generally increase with the number of blades in any one plane until such point that the blades are so close with respect to their transverse dimension that in use the action of any one blade interferes with the action of the following blade. Similarly the useful number of planes of blades is limited by any mutual interference between the planes due to proximity. The addition of further planes of blades increasingly remote from a single axial sparging source may also not increase the fluide dispersing efficiency of the turbine, but may still assist mixing of the liquid and/or liquid-fluid dispersion in the reservoir.

Subject to the foregoing suitable blade numbers include 2 to 24 coplanar blades, typically 4 to 12, and up to 5 planes of blades, typically 1.

Typically, dimensions of the rotor are determined by the size of the reservoir, and usually the diameter will be one third to a half the corresponding reservoir transverse dimension.

The fluid sparging means may have a single aperture, or multiple apertures such as a row, grid, rose or ring. Although the sparging of liquids, in particular those less dense than the reservoir liquids, is not excluded, the sparged fluid will often be a gas.

The rotor and fluid sparging means may be placed in any orientation and mutual position which ensures that the fluid is delivered either to the volume swept by the rotor blades or to any directly adjacent zone on which any liquid flow generated by the rotor blades impinges (in both cases 'the dispersion zone').

The rotor may be mounted in any orientation, although it will often be convenient to mount it upright with the sparging means mounted on the reservoir above or below it, e.g. spaced axially from it, so that the fluid may be delivered to the dispersion zone through the liquid essentially under gravity, either from below for a gas or liquid less dense than the reservoir liquid or from above for a denser liquid. The sparging means may then suitably be a hole, rose or ring coaxial with the rotor.

As is common with turbine agitators the blades will not generally extend from the rotor shaft itself but will each be mounted on an arm or an equivalent structure on the shaft. It will be apparent that an axial hole, rose or ring sparging means smaller in diameter than the overall rotor diameter which does not overlap the blades will not deliver fluid to the dispersion zone without a deflector. In such a case the blades may conveniently be mounted extending from the periphery of a rotor disc, the disc acting as a deflector. With the typical blade dimentions given hereinbefore, the disc will typically be 3D/4 in diameter, where D is the overall rotor diameter.

The fluid may of course be delivered to a zone radially outside the volume swept by the blades, since the liquid pumped into this zone by the blades makes it a dispersion zone; a sparging ring may be used.

Alternatively, the rotor may be mounted crosswise with the sparging means mounted on the reservoir and spaced radially from it above or below, again conveniently to allow delivery essentially under gravity. The sparging means may then suitably be an axially aligned row, a transverse straight or arcuate row or a planar or curved grid depending on the rotor structure.

In another aspect the sparging means may be mounted on the rotor, for example as an aperture or apertures in front of each blade or spaced axially from the or a blade plane.

Orientations of the rotor appropriate to or compatible with the disposition of the sparging means and blades will be self-evident to the skilled man.

Although useful in all applications where dispersion of two fluid phases is required, the present assembly is particularly useful for gas-liquid mass transfer processes, and for low-shear thorough mixing, e.g. of sensitive substrates such as living cell fermentation suspensions or polymer latices or dispersions subject to ready degradation or coagulation.

BRIEF DESCRIPTION OF THE DRAWINGS

The present invention will now be described with reference to three specific embodiments of the rotor and sparging means, depicted in FIGS. 1, 1A, 2, 3 and 4.

DETAILED DESCRIPTION OF PREFERRED EMBODIMENTS

Figure 1:
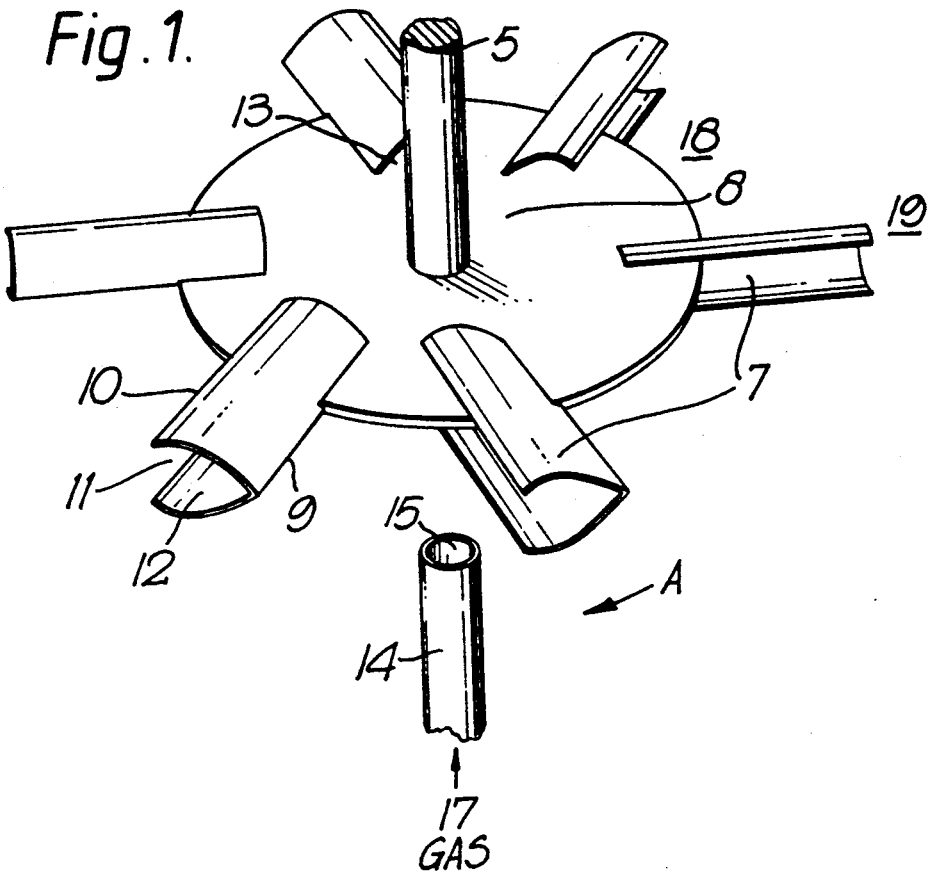
FIG. 1A is a smaller scale schematic view of the apparatus of the invention illustrated in relation to the embodiment of FIG. 1.

In the Figures, a rotor 4 is rotatably mounted vertically within a reservoir 2 capable of holding a liquid 3 to submerge the rotor 4. The rotor 4 consists of a shaft 5 (driven by an electric motor 6 on which a plurality (four or six) radially extending blades 7 are mounted regularly about the shaft 5 in a single plane by means of a disc or arms 8.

Each blade 7 is of symmetrical uniform aerofoil cross-section with a single sphenoidal acute-angle trailing edge 9 extending the length of the blade 7. Each blade 7 is hollow and its leading face 10 has a symmetically disposed slot 11 extending the length of the blade 7. The ends 12 of the blade 7 are open. The blades 7 are mounted such that their central planes of symmetry are coplanar.

Figure 2:
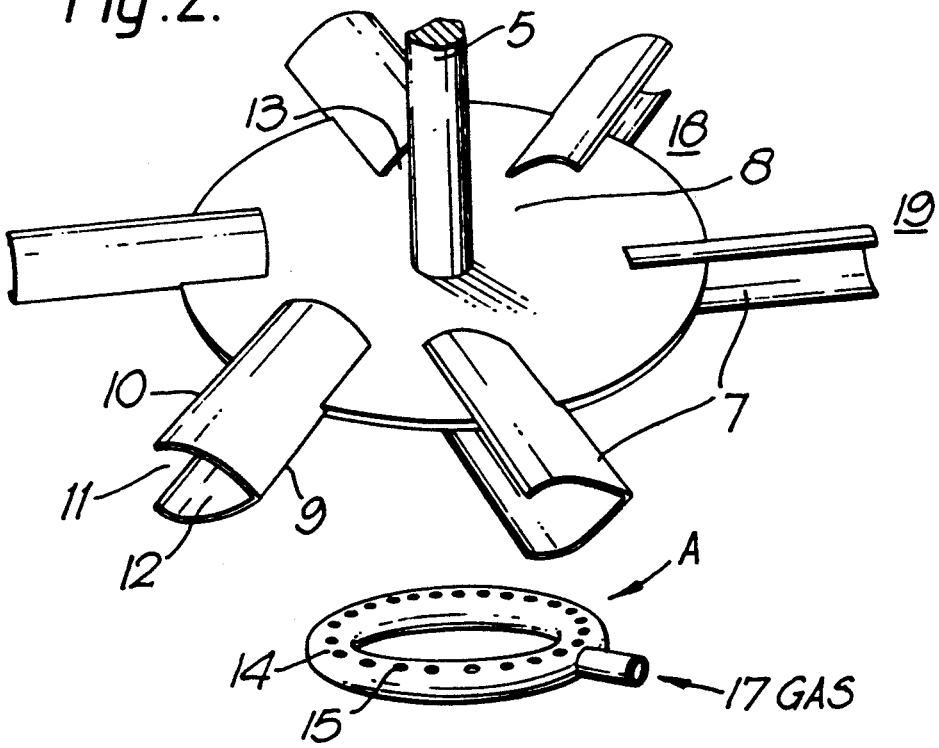
Figure 1A:
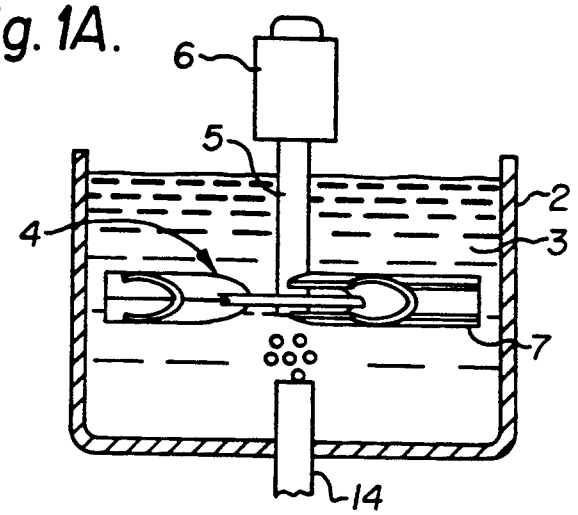
Figure 3:
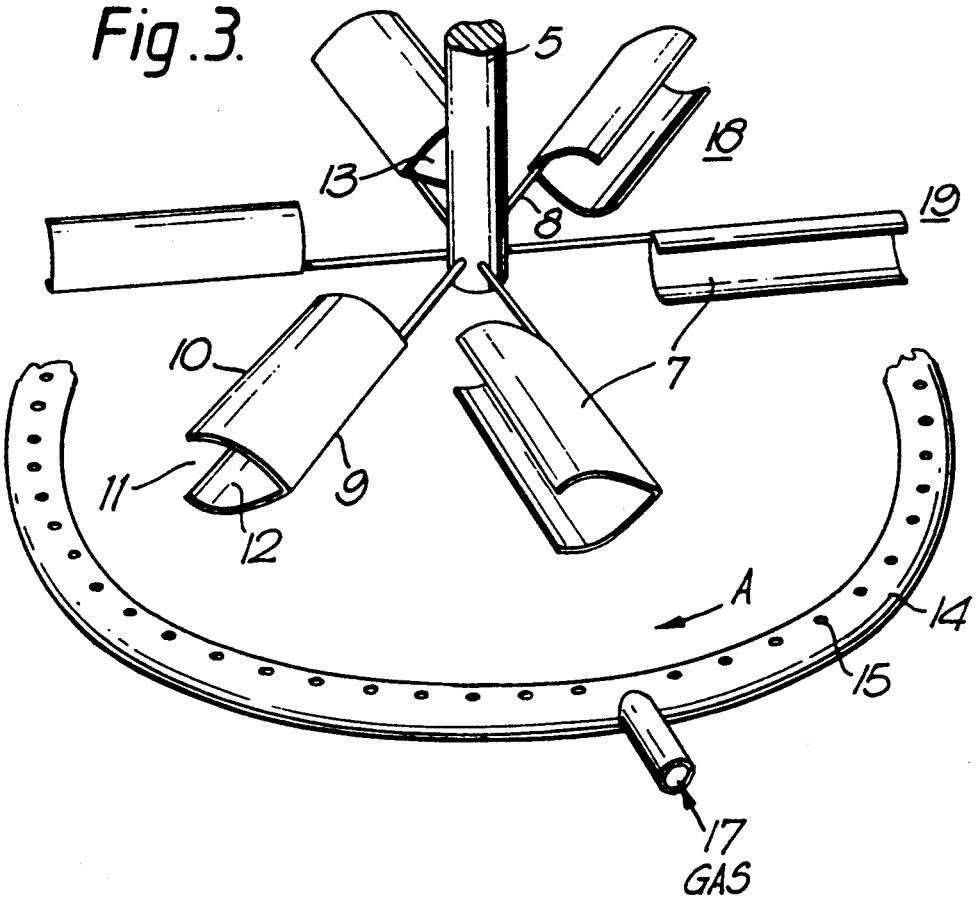
Figure 4:
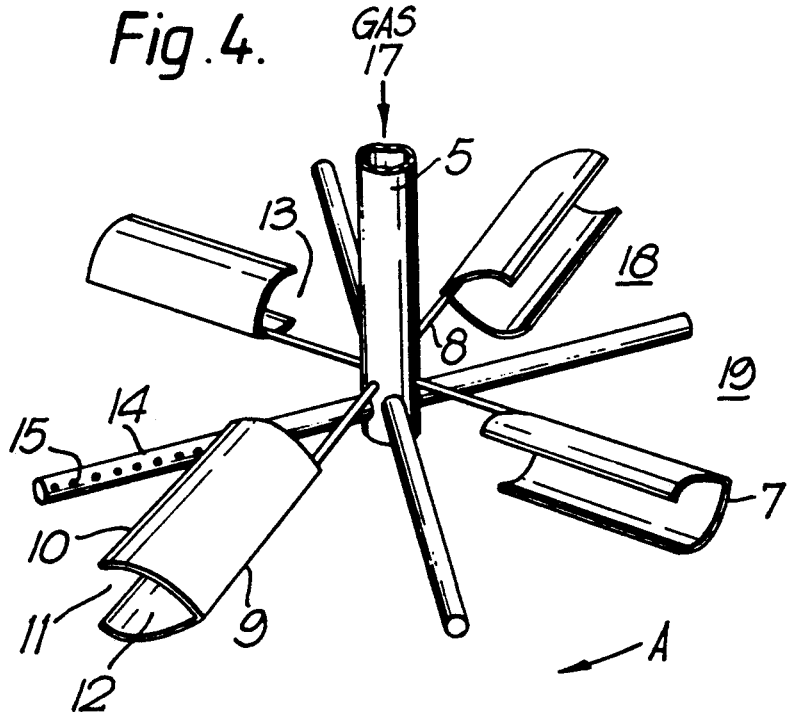

A means for sparging gas 14 is, in FIGS. 1 to 3, mounted on the reservoir below the level of and coaxial with the rotor. In FIGS. 1 and 2 it is a single aperture or a sparging ring of apertures which do not overlap the blades 7. In FIG. 3 it is a sparging ring lying below a zone 19 radially outside the volume 18 swept by the blades in use. In FIG. 4 the sparging means 14 consists of four apertured tubes mounted on, projecting from, and communicating with the hollow interior of the shaft 5, and regularly spread between and coplanar with the blades 6. Their apertures 15 are in the trailing face 16 of each tube 14.

In use, the reservoir 2 is filled with liquid 3 to submerge the blades 7 of the rotor 4, which is then rotated in the direction of arrow A. Gas 17 is then supplied via sparging apertures 15 (in FIG. 4 through the hollow interior of the rotor shaft 5 and rods 13) to the volume 18 swept by the blades (in FIG. 1 by deflection by the disc 8) or the zone 19. In all cases liquid 3 is scooped in by the blades 7 through the slot 11 and discharged through the open blade end 12 into the dispersion zone 19. In FIGS. 1, 2 and 4 the gas 17 flows over the outer surface of the blades 7, and in all cases the gas is dispersed in the zone 19.

Figure 5:
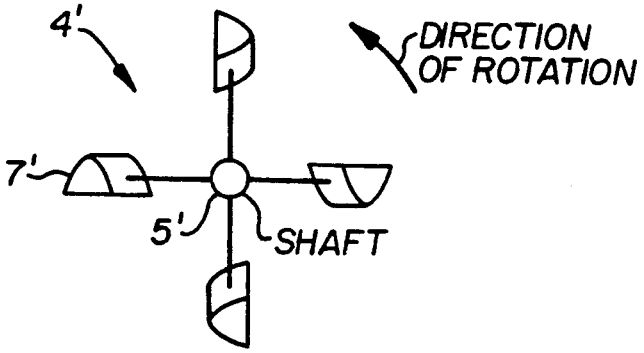
FIG. 5 is a horizontal sectional view of a modified form of the rotor, in which the scoops are tilted from radial, so as to impart an axial component to motion of the discharged fluid.

As shown in FIG. 5, which depicts a modified rotor 4', the scoops or blades 7' may also be set at any angle to the rotor shaft 5' in an axial direction, other than a right angle, in order to provide an axial component to the discharge flow.

We claim:

1. A turbine agitator assembly for mixing a less dense fluid into a more dense liquid contained in a reservoir, comprising:

a rotor including an axially-extending shaft, means for rotating the rotor, in a predetermined direction, a plurality of radially-extending blades arranged in at least one series extending in a circumferential direction about said shaft, and means mounting said blades to said shaft for rotation therewith;

each said blade:

being hollow, having an outer surface which is discontinuous circumferentially of a longitudinal axis of the blade whereby the blade is scoop-shaped, with a mouth forming a leading side of the blade when the rotor is rotated in said predetermined direction, having an open outer end, having only one trailing edge, at which portions of said outer surface approach one another at an acute angle, said trailing edge of each said blade having said portions of said outer surface approaching one another at said acute angle along substantially the whole length of said trailing edge, and having said outer surface be free of external concavity;

a reservoir for containing a quantity of said more dense liquid, in which said blades, in use, are submerged; and means for sparging said less dense fluid into the more dense liquid in said reservoir adjacent said at least one series of blades for dispersal into said more dense liquid by said blades as said rotor is rotated about a longitudinal axis of said shaft.

2. The assembly of claim 1, wherein:

said blade mounting means comprises a disc spatially arranged in relation to said sparging means to deflect said less dense liquid sparging from said sparging means, into a volume of space swept by said blades as said rotor is rotated in use.

3. The assembly of claim 1, wherein:

said sparging means is spatially arranged in relation to said rotor to sparge said less dense liquid into a zone which lies radially outside a volume of space swept by said blade as said rotor is rotated in use.

4. The assembly of claim 1, further including:

means mounting said sparging means to said rotor for rotation therewith.

5. The assembly of claim 1, wherein:

each blade is symmetrical in axially opposite directions, relative to said shaft, from said trailing edge thereof;

each blade is airfoil-like in transverse cross-sectional shape; and each blade has an externally convex leading face in which said mouth is provided which merges smoothly into a sphenoidal trailing part externally having said trailing edge.

6. The assembly of claim 5, wherein:

said externally convex leading face is one of parabolic and elliptical in transverse cross-sectional shape.

7. The assembly of claim 5, wherein:

each said blade includes an internal cavity which opens forwardly through said mouth, and said mouth being provided as a slot which is symmetrically arranged on the blade.

8. The assembly of claim 5, wherein:

said blades have zero pitch relative to the longitudinal axis of the shaft.

9. The assembly of claim 1, wherein:

all of said blades in each said series have the trailing edges thereof arranged in a common plane; and all of said blades in each said series are equiangularly spaced from one another in the circumferential direction relative to said longitudinal axis of said shaft.

10. The assembly of claim 9, wherein:

each series of said blades includes from 4 to 12 blades.

11. A turbine agitator assembly comprising:

a reservoir for liquid;

a rotor mounted in the reservoir and carrying a plurality of blades; means for rotating the rotor in a predetermined direction; and means for sparging a fluid into liquid in the reservoir, the fluid sparging means and the rotor being so constructed and arranged that, in use, the rotor blades and/or the liquid flow they generate disperse the sparged fluid;

each of the blades:

being of scoop-shaped configuration with the mouth thereof forming the leading face of the blade when the rotor is rotated in said predetermined direction;

having an outer surface free of external concavity and an open end through which the liquid is discharged; and being set at an angle to the axis of rotation of the rotor in order to provide an axial component of the discharge flow; each blade having only one trailing edge, at which portions of the outer surface of the blade approach one another at an acute angle, said portions of said outer surface approaching one another at said acute angle along substantially the whole length of said trailing edge.

12. A turbine agitator assembly comprising:

a reservoir for liquid;

a rotor mounted in the reservoir and comprising a shaft on which a plurality of blades are mounted; means for rotating the rotor in a predetermined direction; and means for sparging a fluid into liquid in the reservoir, the fluid sparging means and the rotor being so constructed and arranged that, in use, the rotor blades and/or the liquid flow they generate disperse the sparged fluid;

each of the blades:

being of scoop-shaped configuration with the mouth thereof forming the leading face of the blade when the rotor is rotated in said predetermined direction;

having only one trailing edge, at which portions of the outer surface of the blade approach one another at an acute angle, said portions of said outer surface approaching one another at said acute angle along substantially the whole length of said trailing edge;

having an outer surface free of external concavity and an open end through which the liquid is discharged; and being mounted by an arm extending radially from said shaft.

* * * * *